US006477820B1

(12) United States Patent
Dutra et al.

(10) Patent No.: US 6,477,820 B1
(45) Date of Patent: Nov. 12, 2002

(54) METHOD OF MAKING A PACKAGE WITH A ZIPPER CLOSURE

(75) Inventors: Herberto Dutra, Elk Grove Village, IL (US); Mark Charles Mikol, Glenview, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/364,624

(22) Filed: Jul. 29, 1999

(51) Int. Cl.[7] ..... B65B 61/18

(52) U.S. Cl. ..... 53/412; 53/416; 53/450; 53/452; 53/476; 53/468

(58) Field of Search ..... 53/412, 416, 450, 53/452, 476, 478, 468, 133.3, 133.1, 133.4; 493/210, 212, 213; 24/380, 385, 387, 388, 400

(56) References Cited

U.S. PATENT DOCUMENTS 4,586,319 A * 5/1986 Ausnit ..... 53/468
4,601,694 A * 7/1986 Ausnit ..... 493/213
4,812,074 A 3/1989 Ausnit et al.
4,848,064 A 7/1989 Lems et al.
5,067,208 A 11/1991 Herrington, Jr. et al.
5,080,747 A * 1/1992 Veix ..... 53/477
5,088,971 A 2/1992 Herrington
5,131,121 A 7/1992 Herrington, Jr. et al.
5,161,286 A 11/1992 Herrington, Jr. et al.
5,211,482 A 5/1993 Tilman
5,405,478 A 4/1995 Richardson et al.
5,435,864 A * 7/1995 Machacek et al. ..... 493/213
5,442,837 A 8/1995 Morgan
5,448,807 A 9/1995 Herrington, Jr.
5,482,375 A 1/1996 Richardson et al.
5,519,982 A 5/1996 Herber et al.
5,664,406 A 9/1997 Smith
5,669,715 A 9/1997 Dobreski et al.
5,682,730 A 11/1997 Dobreski
5,687,549 A * 11/1997 Jostler et al. ..... 53/416
5,713,669 A 2/1998 Thomas et al.
5,733,045 A 3/1998 Jostler et al.
5,743,070 A * 4/1998 Lerner et al. ..... 53/468
5,775,812 A 7/1998 St. Phillips et al.

(List continued on next page.)

OTHER PUBLICATIONS

"Hefty's Plastic Zipper Bag Is Rapping Rivals", by Dean Starkman, article in *The Wall Street Journal*, date unknown.

*Primary Examiner*—Stephen F. Gerrity
*Assistant Examiner*—Louis Huynh
(74) *Attorney, Agent, or Firm*—Fitch, Even, Tabin & Flannery

(57) ABSTRACT

A method and apparatus for providing a slider-equipped zipper on a pouch in a form/fill/seal operation. In the preferred embodiment of the invention, a foldable slider is employed, and is shifted from an open configuration to a closed configuration for installation on zipper strips on the pouch. Stops are preferably provided at the ends of the zipper strips by application of heat and pressure to form a boss on one side and a corresponding recess on the other, without requiring additional material. A hermetic peelable seal preferably is provided beneath the zipper strips. The slider preferably is applied to the zipper strips immediately before or immediately after filling, or immediately after formation of the peelable seal. Means may be provided to shift the position of the slider to close the zipper. The slider may include means to secure it in place by a mechanical locking mechanism such as a snap fit engagement, or the slider may be welded in closed position by application of heat, or by ultrasonic welding. A vacuum engagement mechanism may be employed to separate the walls of the pouch to a predetermined position relative to one another while positioning and closing the slider.

5 Claims, 3 Drawing Sheets

U.S. PATENT DOCUMENTS

| | | | | |
|---|---|---|---|---|
| 5,776,045 | A | | 7/1998 | Bodolay et al. |
| 5,788,378 | A | | 8/1998 | Thomas |
| 5,826,401 | A | | 10/1998 | Bois |
| 5,833,791 | A | | 11/1998 | Bryniarski et al. |
| 5,867,875 | A | | 2/1999 | Beck et al. |
| 5,884,452 | A | | 3/1999 | Bois |
| 5,896,627 | A | | 4/1999 | Cappel et al. |
| 5,956,924 | A | * | 9/1999 | Theiman ..... 53/133.4 |
| 6,138,439 | A | * | 10/2000 | McMahon et al. ..... 53/412 |
| 6,244,021 | B1 | * | 6/2001 | Ausnit et al. ..... 53/412 |
| 6,293,896 | B1 | * | 9/2001 | Buchman ..... 493/213 |

* cited by examiner 10
12
14
16
18
20
22
24
26
28
30
32
34
36
38
40
42
43
44
46
48
50
52
54
56
66
80
82
84

METHOD OF MAKING A PACKAGE WITH A ZIPPER CLOSURE

FIELD OF THE INVENTION

The invention relates generally to packaging for food products, and more particularly to zipper-equipped reclosable pouches and methods and apparatus for forming, filling and sealing such pouches.

BACKGROUND OF THE INVENTION

In providing a commercially viable zipper-equipped package, among the considerations that must be addressed are ease of use and economy of manufacture. It is desirable that the package be capable of being formed, filled and sealed at high throughput rates. Additionally, the package must be durable to withstand the stresses of the form/fill/seal operation and subsequent shipping and handling without damage and without deterioration of appearance.

When handling products comprised of numerous small pieces such as shredded cheese, cereal, etc., the package maybe partly formed into an open-topped pouch, and product may be dispensed into the partially-formed pouch through the open top. One approach is to employ a vertical form/fill/seal system, an example of which is shown in U.S. Pat. No. 4,874,257, with the zipper being disposed vertically along one side of the package being formed, and the pouch being filled by gravity-induced flow of product downward from a filling spout. Another approach is illustrated by U.S. Pat. No. 5,519,982, in which the pouches travel horizontally as they are formed, filled and sealed.

In zipper-equipped package, where the ends of the zippers extend into seal areas, difficulty may be encountered in providing seals at high throughput rates, due to the increased thickness of the seal area at the ends of the zipper. Another problem is that opening and reclosing zippers may be difficult for the consumer, even where gripper beads are provided, as discussed in, e.g., U.S. Pat. No. 5,519,982.

To address the latter problem, a slider may be provided in conjunction with the zipper strips. Sliders that may be moved linearly to force the profiles together or apart are well known in the art. However, installation of the slider complicates the manufacturing process. Also, the slider may tend to split the joint between the package walls at the ends of the zipper track, requiring that stops be provided, which further complicates the manufacturing process. Various stop designs are shown in, e.g., U.S. Pat. Nos. 5,833,791; 5,405,478; 5,067,208; 5,448,807; and 5,442,837. U.S. Pat. No. 5,211,482 describes post-filling application of a zipper closure that includes a slider.

There is a continuing need for improved packages of the type described above, and for improved form/fill/seal operations for such packages which address the aforementioned considerations while avoiding the disadvantages of the prior art.

SUMMARY OF THE INVENTION

The invention provides a novel method and apparatus for providing a slider-equipped zipper fastener on a pouch in a form/fill/seal operation.

In the preferred embodiment of the invention, a foldable slider is employed, and is shifted from an open configuration to a closed configuration during installation on zipper strips on the pouch. Integral stops are preferably formed from the zipper material by application of heat and pressure to the ends of the zipper, without requiring installation of separate, discrete components.

A hermetic peelable seal preferably is provided beneath the zipper strips. The slider preferably is applied to the zipper strips immediately before or immediately after filling, or immediately after formation of the peelable seal.

The slider may include means to secure it in closed position on the zipper strips by a mechanical locking mechanism such as a snap fit engagement, or the slider may be welded in closed position by application of heat, or by ultrasonic welding.

An opening mechanism may be employed to separate the walls of the pouch to a predetermined position relative to one another while positioning and closing the slider. The opening mechanism may employ vacuum cups to engage the walls of the pouch.

The zipper strips are in an open position as the slider is installed. After installation of the slider on the zipper, the slider may be moved along the zipper to close the zipper.

The method and apparatus of the invention may be employed in conjunction with packaging of various food products, including but not limited to, e.g., cheese products in shredded, sliced or chunk form, sliced meats, and other food products packaged for retail sale.

Detailed Description of the Preferred Embodiment

The invention is generally embodied in a method and apparatus for forming, filling, and sealing a pouch having reclosable, complementary interengagable zipper strips equipped with a slider to facilitate opening and closing of the zipper strips.

Figures 1, 1A, 4:
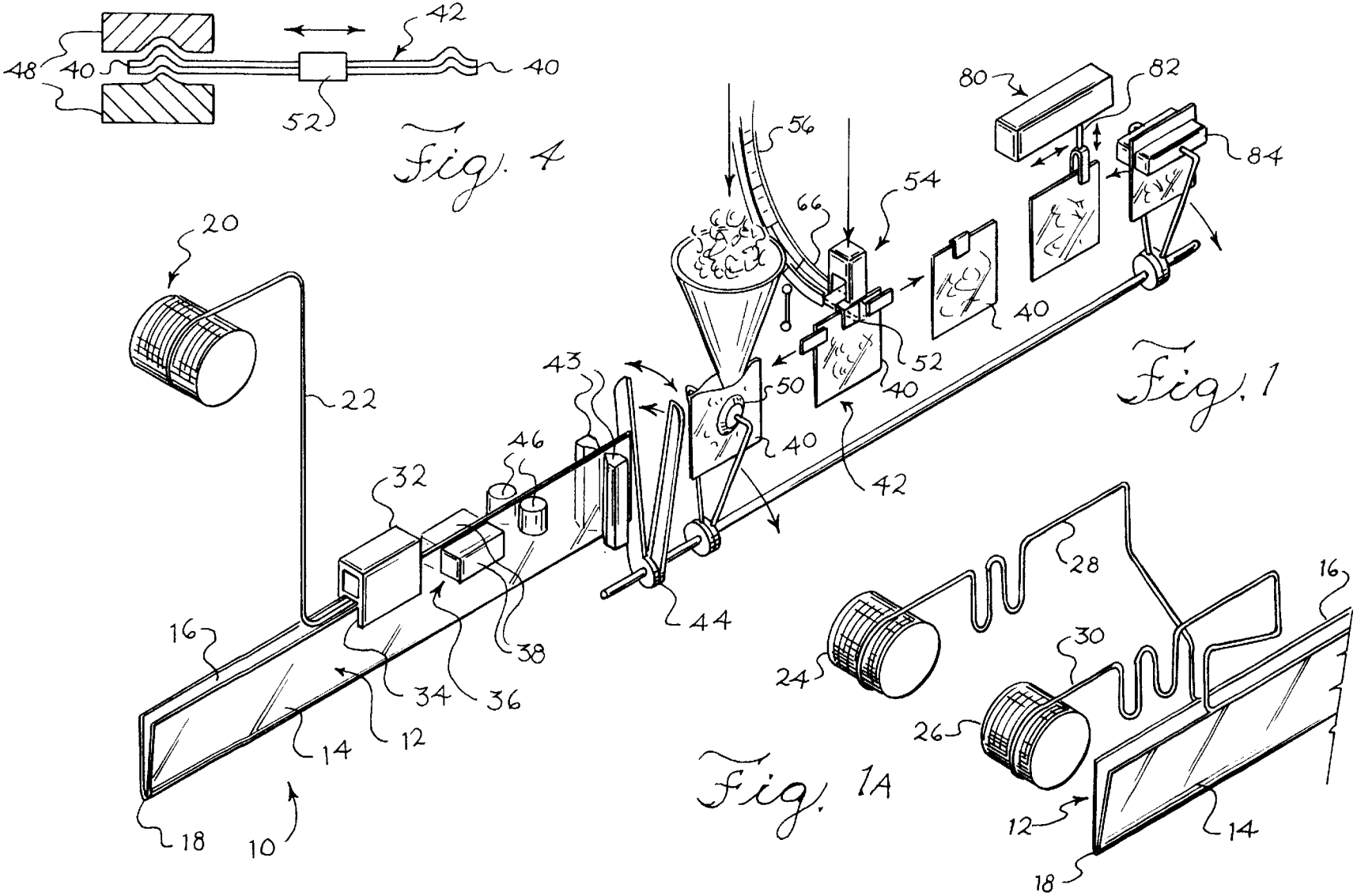
FIG. 1 is a diagrammatic perspective view illustrating a method and apparatus in accordance with a preferred embodiment of the invention.
FIG. 1*a* is a diagrammatic perspective view partially illustrating a second embodiment.
FIG. 4 is a diagrammatic plan view of apparatus for forming stops at the ends of the zipper strips in the apparatus of FIG. 1.

Referring to FIG. 1, the apparatus 10 preferably includes a web 12 of film material for the package walls, comprising first and second wall members 14 and 16. Each of the wall members is oriented in a generally vertical, upstanding position, and the wall members are joined at the bottom by a seal or a fold 18. In the preferred embodiment, the film material is advanced intermittently. In other embodiments, the film material may be advanced continuously.

Zipper strips are inserted between the walls adjacent their upper edges as the wall material is advanced. The zipper strips may comprise a single roll 20 of interlocked strips 22, as shown in FIG. 1, or two separate rolls 24 and 26 having separate zipper strips 28 and 30 thereon, as shown in FIG. 1*a*. The zipper material preferably is of a conventional configuration, with the strips having complementary, interengageable profiles to enable the zipper strips to be interlocked with one another, and flanges or base portions to be welded to the film along the upper edge thereof, with the profiles protruding slightly above the upper edges of the file material.

A zipper chamber 32 receives the zipper strips and aligns them for joinder to the film. A series of tensioning/guiding rollers may be provided to control the zipper strips as they proceed toward the zipper chamber. In the embodiment of FIG. 1, wherein the zipper strips 22 are supplied on a single roll in a joined or interlocked configuration, the zipper chamber 32 separates them prior to aligning them for joinder to the wall material. The zipper chamber is positioned adjacent the upper edges of the wall material and has a central longitudinal slot 34 to receive the zipper strips and the upper portions of the walls.

The zipper strips are joined to the film at a joining station 36. The illustrated joining station comprises a pair of sealing bars 38 positioned on opposite sides of upper portions of the package walls, adjacent the zipper material, and a central dividing plate that keeps the zipper components separate while the flanges of the zipper strips are joined to the film by, e.g., application of heat, or ultrasonic welding. The sealing bars 38 may be transversely reciprocable or may be stationary during operation.

After the zipper strips are joined to the film, side seals 40 are formed to define a pocket or pouch 42 for receiving product. The side seals 40 in the illustrated embodiment are substantially vertical, and are spaced from one another by the desired width of the pocket. The side seals may be formed by a pair of transversely reciprocable heat sealing bars 43, or by other suitable sealing apparatus.

To separate the pouches 42 from the web 12 and from each other, a vertical slit or cut is formed along the center of each side seal. The slit may be formed simultaneously with formation of the side seal, or in a subsequent step as shown by a cutter 44. The cutter can be positioned at any one of several different points, e.g. before filling, immediately after filling, after application of the slider, or at any other desired position.

To provide stops to limit travel of the zipper slider on the zipper in the finished package, the ends of the zipper strips are preferably crushed or molded to form a boss on one side and a recess on the other without adding material. Preferably, heat and pressure are applied to the ends of the zipper strips to accomplish the stop formation.

Formation of the stops is preferably accomplished in two steps. In the first step, a first pair of dies 46 engages the zipper strips at a location corresponding to an end portion of the zipper strips, to apply heat and pressure for a predetermined period of time to crush one end of the zipper and deform the zipper strip ends roughly into the desired configuration. In the second step, upper portions 48 of the heat sealing bars 43 complete the formation of the stops as the side seals are formed.

In other embodiments of the invention, the formation of the stops may comprise a one-step operation, or may involve more than two steps. Furthermore, application of heat and pressure specifically to the zipper end area may be carried out before, during or after formation of the side seals. Also, each step may be performed on two or more zipper ends simultaneously. During formation of the stops, the film is guided by wheels that track the film at the base of the zipper.

Filling of the pouches preferably involves dispensing product downwardly into the pouches through a filling spout to fill the pouches to a predetermined level. In the illustrated embodiment, to provide access to the filling spout, the pouch is opened by use of suction devices, such as vacuum cups 50, applied to the exterior of each wall. In other embodiments, other mechanisms (not shown) may be employed to open the top of the pouch, e.g., by engaging the upper edges of the package walls.

To avoid retention of product by the zipper strips, the filling spout may be vertically movable, so that it may be shifted downward slightly to extend into the pocket during filling.

In the illustrated embodiment, the slider 52 is installed on the zipper at an installation station 54 immediately after filling of the pouch. At the installation station, sliders are fed down a dispensing chute 56, placed in position on the zipper, then clamped onto the zipper. The sliders are preferably supplied to the installation station in bulk form in open position. Batches of sliders are fed to a conventional bowl feeding device that utilizes a combination of chute design, vibratory motion and centrifugal force to orient and discharge the sliders in single file into the dispensing chute. Sensing devices 58 detect presence or absence of the sliders at key zones in the dispensing chute. In the event that the supply of sliders is interrupted, the sensing device may provide a signal to stop the line temporarily. A gate controls the dispensing of the sliders to a metering device. The metering device functions to position the sliders, one at a time, in a centered position relative to the zipper strips.

In the preferred embodiment, an opening device 64 is employed to provide a slot between the zipper strips that is wide enough to allow room for a depending central fin of the slider to fit between the zipper strips. The illustrated opening device employs vacuum cups, applied to the exterior of each wall. In other embodiments, other mechanisms may be employed to open the top of the pouch, e.g., by engaging the upper edges of the package walls.

Figures 2, 3:
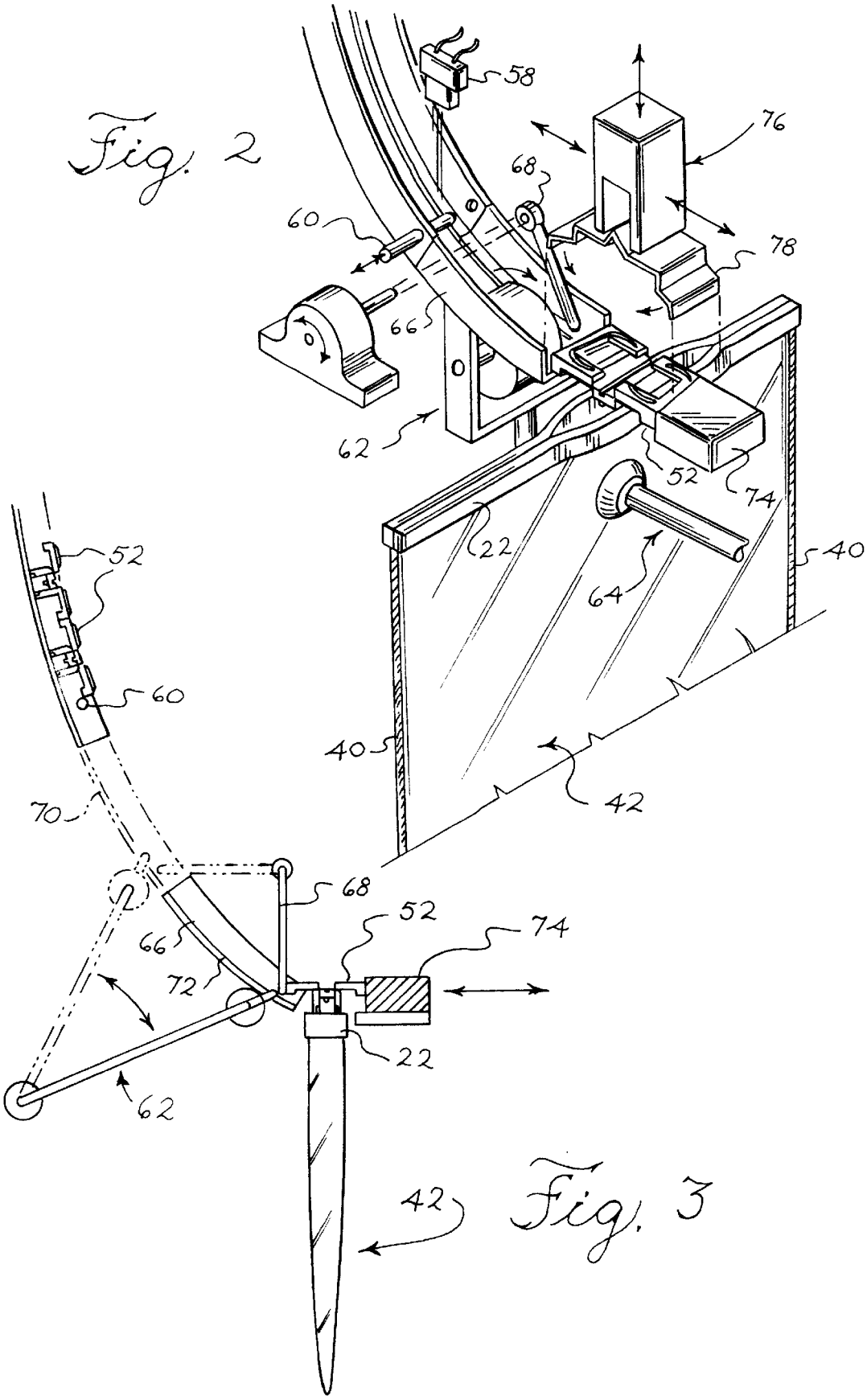
FIG. 2 is a diagrammatic perspective view of apparatus for positioning and closing the slider in the apparatus of FIG. 1.
FIG. 3 is a diagrammatic elevational view of the apparatus of FIG. 2.
Figure 5:
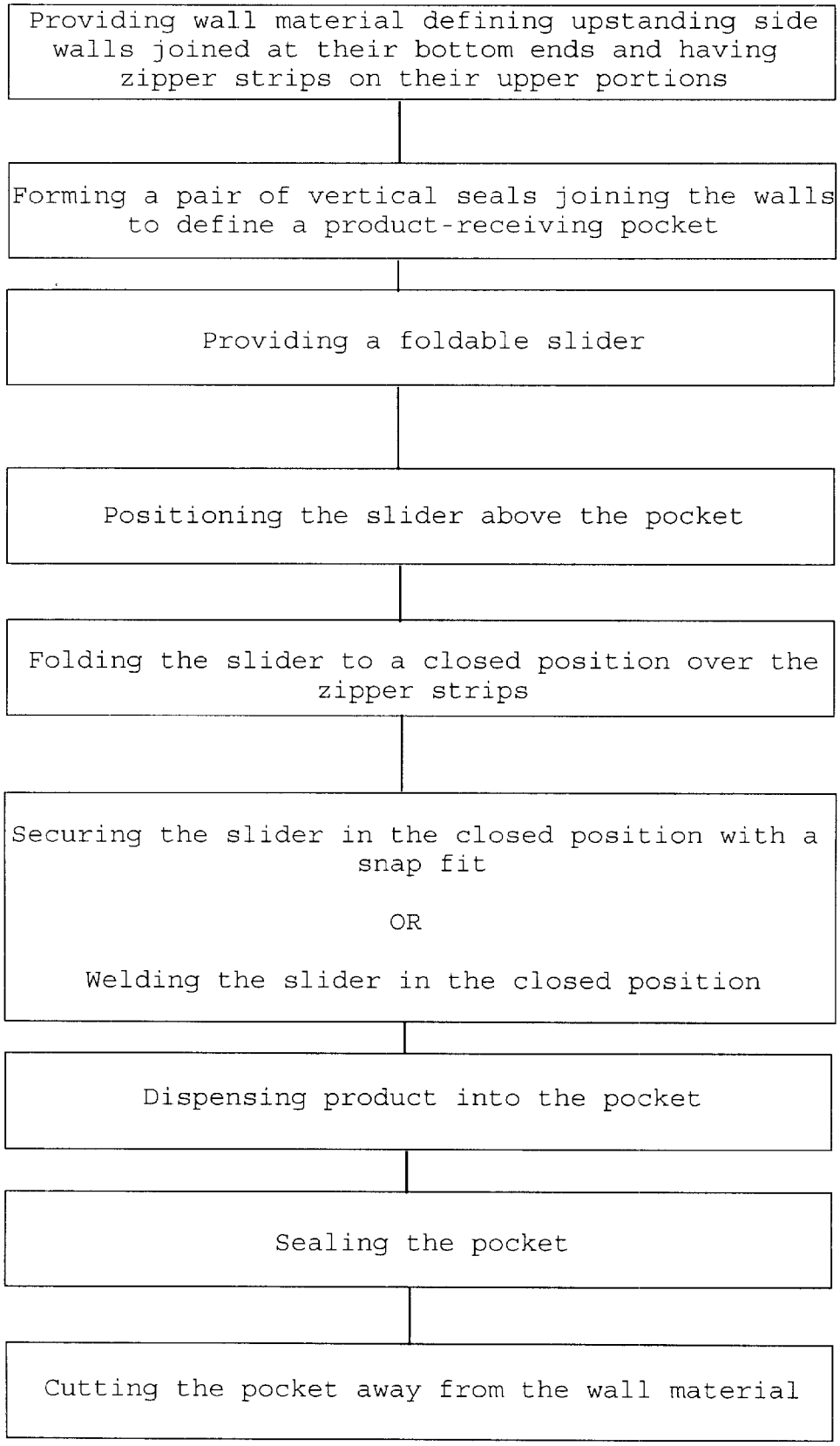
FIG. 5 is a block diagram illustrating operations for forming a pouch according to an embodiment of the invention.

The metering device 62 comprises a reciprocating mechanism that moves a detachable end portion 66 of the dispensing chute from a first position 70, illustrated in broken lines in FIG. 3, to a second position 72, illustrated in solid lines in FIG. 3, where a sweeper 68 pushes the slider from the end portion of the chute against a stop 74, at which point the slider is in position to be clamped onto the zipper. The slider is then closed by a gripper/end effector assembly 76 which is lowered into engagement with the slider. The end effector 78 in the illustrated embodiment is configured to force the slider into its closed position. Mechanical locking means such as a snap fit arrangement may be provided on the slider to lock it in closed position. In other embodiments, the end effector may include apparatus for welding or sealing the slider in its closed position, using, e.g., heat or ultrasonic welding techniques.

While the slider is being clamped in place, the metering device 62 shifts back to its first position, and the gate 60 is opened to permit the next slider to move onto the removable end portion 66 of the chute, and the process repeats itself.

The sweeper 68 in the illustrated embodiment comprises a single elongated member that is rotatable about one of its ends, and is driven intermittently by a rotary actuator in timed relation with reciprocation of the metering device.

In order to maximize throughput rates, multiple slider application stations may be provided in the line.

After installation of the slider, the pouch proceeds to a zipper-closing station 80, where the slider is engaged by a closing device 82, and moved longitudinally relative to the pouch to close the zipper. The closing may be accomplished by a rodless air cylinder with a pneumatic actuator that lowers around the slider and shifts the slider toward its closed position.

A peelable seal is then provided beneath the zipper. In the preferred embodiment, a hermetic peelable seal is applied. The peelable seal may be formed between flange or base portions of the zipper strips by heating sealing bars 84 or other suitable apparatus.

From the foregoing, it should be apparent that the invention provides a novel and improved method and apparatus for application of reclosable zippers to food packaging in form/fill/seal operations, wherein a slider is incorporated into the reclosable zipper arrangement in an economical and commercially practical method and apparatus. The invention is not limited to the embodiment described above, nor to any other particular embodiment. For example, while the slider is installed on the zipper strips after filling and before formation of the peelable seal in the illustrated embodiment, the slider might be applied before filling or after formation of the peelable seal in other embodiments. Also, while the illustrated embodiment shows heat seal bars to perform joining or sealing steps, it is contemplated that these steps might alternatively involve other or additional apparatus to effect joinder or sealing using, e.g., ultrasonic welding, RF sealing, or use of adhesives. Also, the sealing bars may be stationary or transversely reciprocable, or may be disposed on wheels or belts so as to have a longitudinal motion component, so that joinder or sealing may be carried out with either intermittent or continuous travel of the film.

The invention is further described and pointed out in the following claims.

We claim:

1. A method of forming, filling and sealing a pouch for food products, comprising:

providing wall material defining a pair of upstanding side walls joined to one another at their bottom ends and having complimentary interengageable fastener strips extending between said side walls on upper portions thereof;

forming a pair of spaced-apart substantially vertical seals separated by a preselected distance joining said side walls so as to define a product-receiving pocket having a width determined by the pre-selected distance between said vertical seals;

dispensing product between said fastener strips, downwardly into said product-receiving pocket;

interengaging said fastener strips one with another to seal the pocket;

providing a slider;

engaging the slider with the fastener strips after product is dispensed to fill said pocket;

crushing the ends of said fastener strips to maintain said slider captive on said fastener strips; and cutting the pocket away from the wall material to form an individual pouch.

2. The method in accordance with claim 1 further comprising the step of forming a hermetic peelable seal beneath said fastener strips and between said side walls.

3. The method in accordance with claim 2 wherein said step of forming a hermetic peelable seal is performed after the pocket is filled and the slider is mounted to said fastener strips.

4. The method in accordance with claim 1 wherein said fastener tracks are engaged after said slider is mounted to said fastener tracks.

5. A method in accordance with claim 1 further comprising shifting the position of the slider to close the fastener strips.

* * * * *

UNITED STATES PATENT AND TRADEMARK OFFICE

CERTIFICATE OF CORRECTION

PATENT NO. : 6,477,820 B1
DATED : November 12, 2002
INVENTOR(S) : Dutra et al.

It is certified that error appears in the above-identified patent and that said Letters Patent is hereby corrected as shown below:

Title page, Item [54] and Column 1, line 1,
Before "PACKAGE", delete "METHOD OF MAKING A".

Column 6,
Lines 30 and 31, change "tracks" to -- strips --.

Signed and Sealed this

Nineteenth Day of August, 2003

JAMES E. ROGAN
*Director of the United States Patent and Trademark Office*